United States Patent [19]

Drucker

[11] 4,030,243

[45] June 21, 1977

[54] PUSH TOY

[76] Inventor: Howard Drucker, 35 Great Rock Road, Sherbon, Mass. 01770

[22] Filed: Apr. 12, 1976

[21] Appl. No.: 676,236

Related U.S. Application Data

[63] Continuation-in-part of Ser. No. 623,560, Oct. 17, 1975.

[52] U.S. Cl. ..... 46/241; 46/205
[51] Int. Cl.[2] ..... A63H 33/26
[58] Field of Search ..... 46/202, 234, 236, 241

[56] References Cited

UNITED STATES PATENTS

| | | | |
|---|---|---|---|
| 2,645,878 | 7/1953 | Johnson | 46/241 |
| 3,864,872 | 2/1976 | Hoetzel | 46/241 |
| 3,940,881 | 3/1976 | Drucker | 46/241 |

*Primary Examiner*—Louis G. Mancene
*Assistant Examiner*—Robert F. Cutting
*Attorney, Agent, or Firm*—Morse, Altman, Oates & Bello

[57] ABSTRACT

A push toy with a carriage having a front bumper. A movable magnet is mounted to the bumper for engagement and disengagement with a magnetically cooperating member on a toy vehicle. A control is connected to the magnet for retracting the magnet into the bumper for disengaging the push toy and toy vehicle.

10 Claims, 4 Drawing Figures

PUSH TOY

CROSS-REFERENCE TO RELATED APPLICATIONS

This application is a continuation-in-part of my pending application Ser. No. 623,560, filed Oct. 17, 1975.

BACKGROUND OF THE INVENTION

The present invention pertains to children's toys and, more particularly, relates to trundle toys. Specifically, the present invention is directed towards a steerable trundle toy that magnetically interacts with toy vehicles.

SUMMARY OF THE INVENTION

An object of the present invention is to provide a push toy that magnetically interacts with a toy vehicle so that the toy vehicle is pushed in different directions by maneuvering the push toy.

Another object of the present invention is to provide a steerable push toy that magnetically cooperates with a toy vehicle. The push toy is characterized by a wheeled base having a handle at a rearward portion and a bumper at a forward portion. A magnet is constrained within a forward section of the bumper for engagement and disengagement with a magnetically cooperating member on the toy vehicle. A control mechanism mounted to the handle is operatively connected to the magnet for retracting the magnet inwardly of the bumper leading edge and for disengaging the push toy and toy vehicle.

BRIEF DESCRIPTION OF THE DRAWINGS

A fuller understanding of the nature and objects of the present invention will become apparent upon consideration of the following detailed description taken in connection with the accompanying drawings, wherein.

DETAILED DESCRIPTION OF THE PREFERRED EMBODIMENTS

Figure 1:
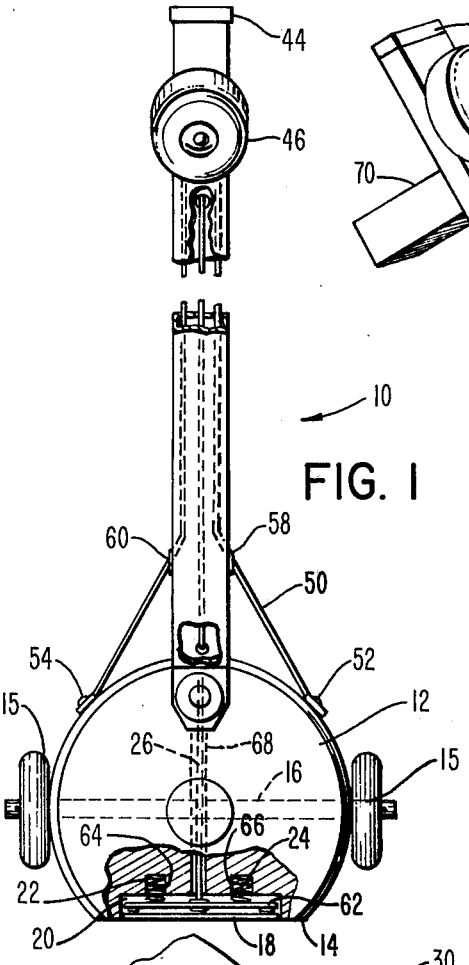
FIG. 1 is a top plan view of a push toy embodying the invention.

Referring now to the drawings, particularly FIG. 1, there is shown a push toy 10 embodying the present invention. Push toy 10 is organized about a base 12 having a generally annular profile with a flat forward position 14, base 12 defines a carriage and forward section 14 defines a front bumper. Base 12 is composed of a natural or synthetic material such as wood or plastic, for example. Carriage 12 is carried on a pair of side wheels 15 that are rotatable about an axle 16 which is mounted to the underside of the carriage. A bar 18 is constrained for reciprocal movement within a cavity 20 formed in carriage 12 and opened at bumper 14. Bar 18 is movable between an extended position and a retracted position. In the extended position, a forward face of bar 18 is substantially flush with bumper 14. In the retracted position, the forward face of bar 18 is drawn inwardly of cavity 20. Bar 18 is held in the extended position by means of bias elements 22, 24, for example springs, and is moved to the retracted position by means of a control cable 26. When in its extended position, bar 18 magnetically cooperates with a member 28 on a toy vehicle 30, shown in FIG. 3. One of bar 18 and member 28 is composed of a magnetized material and the other of bar 18 and member 28 is composed of a magnetically responsive material. In the illustrated embodiment, bar 18 is a magnet and member 28 is composed of steel.

Figure 2:
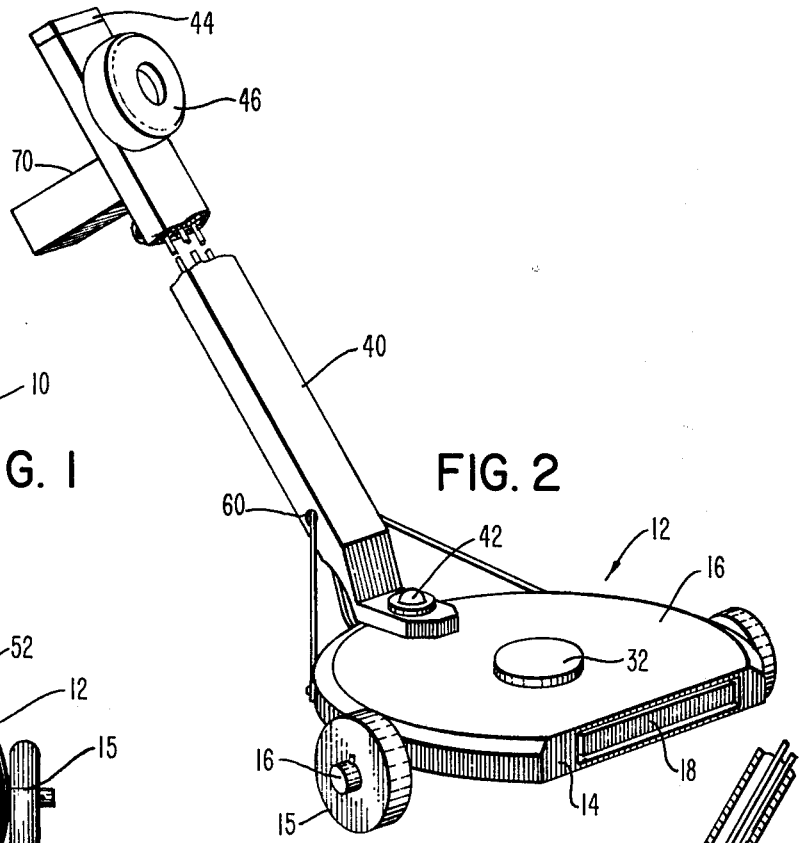
FIG. 2 is a perspective view of the push toy of FIG. 1.
Figure 3:
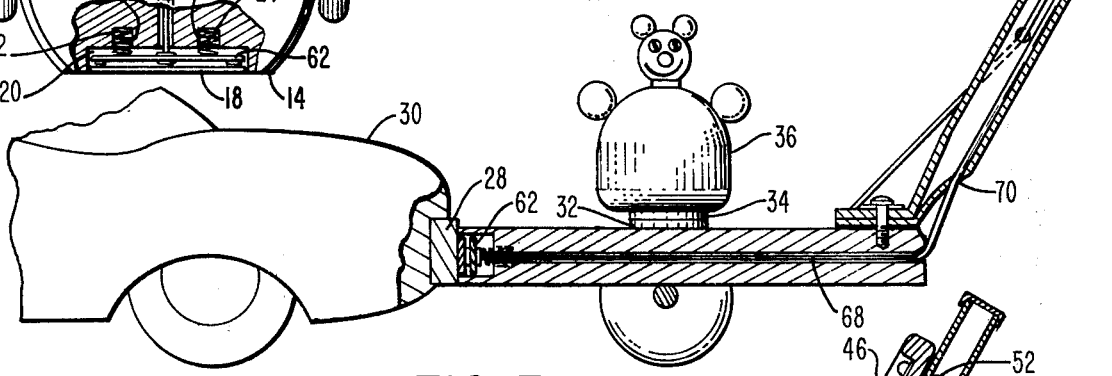
FIG. 3 is a side elevation of the push toy of FIG. 1 magnetically engaging a toy vehicle.
Figure 4:
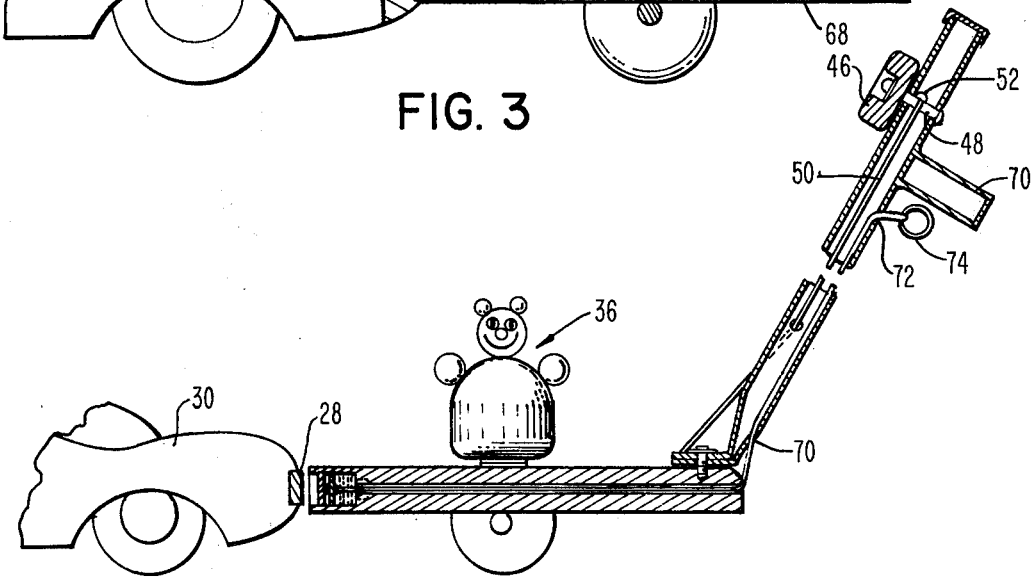
FIG. 4 is a side elevation of the push toy of FIG. 1 disengaged from the toy vehicle.

As shown in FIGS. 2 and 3, on the top of carriage 12 there is mounted a disc 32 which magnetically cooperates with a base 34 of a removable toy 36 for holding the removable toy on the carriage. One of disc 32 and base 34 is composed of a magnetized material and the other of disc 32 and base 34 is composed of a magnetically responsive material. In the illustrated embodiment disc 32 is a magnet and base 34 is steel. Removable toy 36 is in the form of a happy figure that pleases a child, for example a clown as shown in FIGS. 3 and 5.

Carriage 12 is pushed by means of an elongated stick 40 which in the illustrated embodiment is an extruded hollow member composed of a plastic. One end of stick 40 is pivotally mounted to a rearward portion of carriage 12 by means of a pin 42. The opposite end of stick 40, which defines a handle, is provided with an end cap 44. A steering wheel 46 is rigidly secured to a shaft 48 which is rotatably mounted to stick 40 adjacent end cap 44. A cable 50 is fastened to shaft 48 by means of a screw 52, for example. The terminal ends of the cable being attached to carriage 12 by screws 54, 56, cable 50 extends from the interior of stick 40 through openings 58, 60. The arrangement of steering wheel 46 and cable 50 is such that when the steering wheel is rotated in one direction, carriage 12 turns in that direction, and when the steering wheel is rotated in an opposite direction, the carriage turns likewise in the opposite direction. That is, rotation of steering wheel 46 causes carriage 12 to move relative to stick 40, whereby the carriage is steered in any direction.

As previously indicated, magnet 18 is operative to magnetically cooperate with member 28, for example a rear bumper of toy vehicle 30. When magnet 18 and rear bumper 28 are magnetically attached, a child is able to push toy vehicle in any direction by maneuvering push toy 10. Magnet 18 and rear bumper 28 are magnetically attached when the magnet is in its extended position (FIG. 3) and are disengaged when the magnet is in its retracted position (FIG. 5). The movement of magnet 18 relative to bumper 14 is governed by control cable 26.

As shown in FIG. 1, one end of control cable 26 is secured to a plate 62 which is mounted to the rear of magnet 18. In alternative embodiments, control cable is connected directly to magnet 18. One end of each spring 22, 24 presses against the rear face of plate 62, the springs being in an extended state. The other ends of springs 22 and 24 are snugly received in cylindrical openings 64 and 66, respectively. Control cable 26 is threaded through an internal passage 68 in carriage 12 and extends from the rear end of the carriage. Control cable 26 passes into the interior of stick 40 through an opening 70 and exits the stick through an opening 72. A stop 74, for example a ring, which is attached to the other end of control cable 26, limits forward movement of magnet 18. A grip 70 is mounted to stick 40 between opening 72 and shaft 48, grip 70 and steering wheel 46 being on opposite faces of the stick.

In operation, a child maneuvers push toy 10 so that front bumber 18 is positioned against rear bumper 28 of toy vehicle 30. In this position, front bumper 18 is magnetically attached to rear bumper 28 and toy vehicle 30 is pushed by push toy 10. Thus, the toy vehicle is moved in any desired direction as the child maneuvers push toy 10 by turning steering wheel 46. The push toy and toy vehicle are disengaged by the child pulling on ring 74 which draws magnet 18 into cavity 20, springs 22 and 24 being compressed. When magnet 18 is in its retracted position, push toy 10 is moved away from toy vehicle 30.

Since certain changes may be made in the foregoing disclosure without departing from the scope of the invention herein involved, it is intended that all matter contained in the above description and depicted in the accompanying drawings be construed in an illustrative and not in a limiting sense.

What is claimed is:

1. A push toy configured to interact magnetically with a toy vehicle having a magnetically cooperating member, said push toy comprising:

a. a base;

b. at least a pair of side wheels mounted to said base;

c. a movable magnetically cooperating member mounted to said base, said movable member constrained for movement between extended and retracted positions relative to a forward end of said base;

d. a control stick mounted to said base at a rearward portion thereof, said control stick extending outwardly from said base and defining a handle for maneuvering said push toy; and e. control means operatively connected to said movable member for moving said movable member between said extended and retracted positions, said magnetically cooperating member of said toy vehicle magnetically attachable to said movable member in said extended position, said magnetically cooperating member of said toy vehicle detached from said movable member in said retracted position.

2. The push toy as claimed in claim 1 wherein said base is formed with an opening at its forward end, said movable member received within said opening, a leading face of said movable member being substantially flush with said forward end of said base when said movable member is in said extended position, said movable member moved inwardly of said opening when in said retracted position.

3. The push toy as claimed in claim 2 wherein said control means includes bias means and cable means, said bias means within said opening in contact with said movable member, one end of said cable means operatively connected to said movable member, the other end of said cable means at said handle, said bias means forcing said movable member into its extended position, said movable member is moved to its retracted position by pulling said cable means and overcoming the force of said bias means.

4. The push toy as claimed in claim 1 including a steering wheel rotatably mounted to said handle and means connected to said steering wheel and said base for moving said base relative to said handle.

5. The push toy as claimed in claim 1 wherein one of said magnetically cooperating member of said toy vehicle and said movable magnetically cooperating member of said push toy is a magnet and the other of said magnetically cooperating member and said movable magnetically cooperating member is a magnetically responsive member.

6. A combination toy comprising:

a. a push toy with a carriage supported on a pair of wheels, a handle pivotally mounted to said carriage at a rearward portion, said carriage and said handle relatively movable with respect to one another, a magnet mounted to a front end of said carriage, said magnet movable between an extended position and a retracted position, control means connected to said magnet for moving said magnet between said extended and retracted positions, said magnet being substantially flush with said front end of said carriage when in said extended position, said magnet being drawn inwardly of said front end of said carriage when in said retracted position; and b. a toy vehicle with a base having a magnetically cooperating portion, said magnet magnetically attachable to said magnetically cooperating portion of said base when said magnet is in said extended position, said magnet detached from said magnetically cooperating portion when said magnet and said magnetically cooperating portion are magnetically attached and said magnet is moved from said extended position to said retracted position.

7. The combination toy as claimed in claim 6 wherein said carriage is formed with an opening at said front end, said magnet constrained for movement within said opening, spring means disposed within said opening for holding said magnet in said extended position, a first cable, one end of said first cable is operatively connected to said magnet and the other end of said first cable extends through a port in said handle, a child pulling on said cable moves said magnet from said extended position to said retracted position.

8. The toy combination as claimed in claim 7 wherein said push toy includes a steering wheel and a second cable, said steering wheel rotatably mounted to said handle, said second cable operatively connected to said steering wheel and said carriage for moving said carriage relative to said handle when said steering wheel is rotated.

9. The toy combination as claimed in claim 8 wherein said magnetically cooperating portion of said toy vehicle is a steel bar mounted to said toy vehicle.

10. The toy combination as claimed in claim 8 including a stop mounted to said second cable for limiting movement of said magnet.

* * * * *